US007011331B2

(12) United States Patent
Riepler

(10) Patent No.: US 7,011,331 B2
(45) Date of Patent: Mar. 14, 2006

(54) BOARD-LIKE GLIDING DEVICE, IN PARTICULAR A SKI OR SNOWBOARD

(75) Inventor: Bernhard Riepler, Wagrain (AT)

(73) Assignee: ATOMIC Austria GmbH, Pettenbach (AT)

( * ) Notice: Subject to any disclaimer, the term of this patent is extended or adjusted under 35 U.S.C. 154(b) by 137 days.

(21) Appl. No.: 10/168,776

(22) PCT Filed: Dec. 14, 2000

(86) PCT No.: PCT/AT00/00341

§ 371 (c)(1),
(2), (4) Date: Oct. 28, 2002

(87) PCT Pub. No.: WO01/45810

PCT Pub. Date: Jun. 28, 2001

(65) Prior Publication Data

US 2003/0102651 A1 Jun. 5, 2003

(30) Foreign Application Priority Data

Dec. 22, 1999 (AT) ..... A 2156/99

(51) Int. Cl.
*A63C 5/14* (2006.01)

(52) U.S. Cl. ..... 280/601; 280/607; 280/610

(58) Field of Classification Search ..... 280/11.12, 280/600, 602, 607, 608, 609, 610, 11.14, 280/11.17, 14.21, 601
See application file for complete search history.

(56) References Cited

U.S. PATENT DOCUMENTS

| | | | | |
|---|---|---|---|---|
| 5,016,901 A | | 5/1991 | Mayr | |
| 5,197,752 A | * | 3/1993 | Engelbert et al. | 280/610 |
| 5,207,445 A | * | 5/1993 | Hoelzl | 280/607 |
| 5,221,105 A | * | 6/1993 | Mayr et al. | 280/633 |

(Continued)

FOREIGN PATENT DOCUMENTS

| | | |
|---|---|---|
| AT | 388 875 | 9/1989 |

(Continued)

*Primary Examiner*—Christopher P. Ellis
*Assistant Examiner*—Brian Swenson
(74) *Attorney, Agent, or Firm*—Collard & Roe, P.C.

(57) ABSTRACT

The invention relates to a board-type runner device (1), in particular a ski (2) or a snowboard, comprising several layers disposed between a running surface facing (4) and a top layer (6) and a core component (15). At least a bottom face (19) of the core component (15) adjoins a layer (20) that is elastically flexible and rebounds when forces are applied to it. The core component (15), which is mounted on the elastic layer (20) so as to be flexible at least in the direction perpendicular to a running surface (3) of the runner device (1), has compression-resistant projections (21) formed on its top face (23) or separate compression-resistant spacing elements (22) are supported directly on its top face (23). Fixing screws (25) for binding parts or for mounting rails thereof or binding plate(s) are anchored in the projection (21) of the core component (15) only or are additionally also anchored in the core component (15) or the fixing screws (25) are retained in the core component (15) exclusively in a load-bearing arrangement with the spacing element (22) inserted in between.

23 Claims, 8 Drawing Sheets

U.S. PATENT DOCUMENTS

| | | | | |
|---|---|---|---|---|
| 5,599,036 | A * | 2/1997 | Abondance et al. | 280/602 |
| 5,649,717 | A * | 7/1997 | Augustine et al. | 280/610 |
| 5,944,335 | A | 8/1999 | Riepler | |
| 6,102,428 | A * | 8/2000 | Bobrowicz | 280/607 |
| 6,217,041 | B1 * | 4/2001 | Hauser et al. | 280/14.22 |
| 6,293,567 | B1 * | 9/2001 | Menges | 280/14.21 |
| 6,520,529 | B1 * | 2/2003 | DeRocco et al. | 280/610 |

FOREIGN PATENT DOCUMENTS

| | | |
|---|---|---|
| AT | 393 224 | 9/1991 |
| AT | 394 142 | 2/1992 |
| DE | 2 127 330 | 12/1972 |
| DE | 39 34 888 | 5/1990 |
| DE | 39 25 491 | 2/1991 |
| DE | 40 33 780 | 5/1991 |
| DE | 195 11 080 | 9/1996 |
| DE | 196 30 465 | 1/1998 |
| EP | 0 354 379 | 2/1989 |
| EP | 0 474 967 | 3/1992 |
| FR | 2 793 421 | 11/2000 |

* cited by examiner

BOARD-LIKE GLIDING DEVICE, IN PARTICULAR A SKI OR SNOWBOARD

CROSS REFERENCE TO RELATED APPLICATIONS

Applicant claims priority under 35 U.S.C. §119 of Austrian Application No. A 2156/99 filed Dec. 22, 1999. Applicant also claims priority under 35 U.S.C. §365 of PCT/AT00/00341 filed Dec. 14, 2000. The international application under PCT article 21(2) was not published in English.

The invention relates to a board-type runner device, in particular a ski or a snowboard.

Patent specification DE 39 25 491 A1 discloses a ski with a plate arrangement integrated in the ski body, incorporating at least one retaining plate for fixing ski binding parts onto the ski body. Fully integrated in the ski body, this retaining plate extends within the standard binding region in the longitudinal direction of the ski, in other words not substantially farther than beyond the points used to screw in the binding. The reason for this is to prevent, as far as possible, any interference of this retaining plate with the other parts and with the flexibility characteristics of the ski. This retaining plate, in which the fixing screws for the ski binding parts are intended to produce the most solid hold, is arranged in a recess in the top face of a standard wooden core of the ski body with an elastomeric layer disposed in between. An elastomer layer is also provided on the top face of the retaining plate, within the core recess. The two thin elastomer layers cover the top and bottom faces of the retaining plate as fully as possible and extend only slightly beyond the end faces of the retaining plate in the ski longitudinal direction. Provided above the first elastomer layer and underneath the wooden core is a generally standard metallic layer, in particular a thin aluminium plate, which strengthens the ski structure. In addition, this multi-layered structure is provided with a covering layer at the side faces and on the top face, whilst a running surface facing with good sliding properties is provided on the underside. To ensure that the retaining plate to be integrated in the ski body has as little effect as possible on the flexibility characteristics of the ski, it is proposed this it should be of as short and thin a design as possible but this has a detrimental effect on the maximum achievable force for retaining the ski binding parts on the ski body. Furthermore, due to the fact that they are disposed close to the upper peripheral region of the ski structure, the retaining plate and the elastomer layers are subjected to a relatively high degree of local mechanical stress and compression and tensile stress, which can cause the binding fixture to lift from the ski top surface under extreme circumstances because the retaining plates, being of a small surface area, subject the layers in the upper peripheral regions of the ski structure to a high degree of stress in a relatively small surface region and try to lift these layers and force them up in a vertical direction. The elastomer layers are unable to fulfil their intended function of providing compensation for longitudinal displacements when the ski is flexed because the fixing screws for the ski binding points also penetrate the ski core, the thickness of the ski core being relatively large compared with that of the uppermost layers, which prevents relative displacements between the retaining plates and the ski core in the ski longitudinal direction.

The underlying objective of the present invention is to propose a possibility of providing a high-strength anchoring system for a binding point of a board-type device, which avoids localised stress at specific points of individual components of the runner device and is simultaneously capable of meeting the opposing requirement of ensuring that the binding holder kept as far as possible uncoupled from the runner device structure.

This objective is achieved by the invention due to the features defined in claim 1.

The advantage of the features defined in the characterising part of claim 1 resides in the fact that a binding for retaining a shoe of user which can be mounted on a runner device as proposed by the invention is retained from the core region of the runner device and the means of support for the binding is limited almost completely to the core zone of the runner device. As a a result, this firstly produces a very strong retaining hold of the binding parts on the runner device. In particular, the fact that the thickness of the layer which remains above the core component retaining a binding is relatively large, means that it effectively counteracts any lifting or delamination of the layers or plies arranged above the core component. Since the binding mounting or binding retaining system is concentrated in the core region of the runner device, the outer layers and peripheral regions of the binding retaining system in the sandwich structure, which also fulfil a supporting function, are barely affected at all, and in particular are hardly weakened at all. Furthermore, these outer layers or peripheral regions are also no longer clamped to the core component by the binding part to be mounted and instead a direct load bearing means is provided in the form of projections or by spacing elements between the binding to be mounted and the inlaid or embedded core component and vice versa. Since the core component extends across virtually the entire length of the runner device, the forces and stress exerted on the core component by a binding part are widely distributed in the interior of the multi-layered element, so that specific points of the ski binding no longer constitute a source of localised stress on individual parts of the runner device. Another significant advantage of the design proposed by the invention is that the binding is nevertheless uncoupled from the runner device structure to a certain degree due to the elastic layer so that impacts or vibrations acting on the running surface of the runner device are transmitted to the binding and hence the foot of the user in damped form only. The quasi-floating bearing of the core component in the centre region of the runner device therefore produces the best damping properties in terms of running.

With an embodiment of the type defined in claim 2, a binding part to be mounted on the runner device, preferably a two-part binding unit consisting of front and heel jaws, can be directly and rigidly supported on the core component, which is elastically integrated in the runner device body. The key aspect of this is that no relative displacements at all can occur between the core component receiving the binding and the corresponding binding part, since the core projections or separate spacing elements have a high compression strength.

The features defined in claim 3 enable pulse-type impacts or vibrations acting on the running surface of the runner device to be damped, reducing localised strain on the user's foot and making it possible to use the runner device for a long period without becoming tired.

The embodiment defined in claim 23 prevents scratch and shearing marks between the two relatively displaceable parts, which in the longer term can check the capacity for relative displacement.

A functionally safe structure permitting sufficient relative displacement between the two core components is achieved as a result of the features defined in claim 15, which also makes for good mechanical integrity of the individual parts.

The embodiment defined in claim 16 permits a relative displacement between the individual core components and the force of the elastic layer always guarantees that individual core components always assume a defined initial or non-operating position.

With the embodiment defined in claim 21, standard elements may be used as a core component for the runner device, thereby keeping down the cost of producing a runner device of this type.

An optimum compromise between high strength and lightweight structure can be obtained as a result of the characterising features defined in claims 22.

The expanded synthetic material characterised in claim 17, used to provide an elastic bed for the entire core element and for the core element retaining the binding, makes the runner device easy and inexpensive to manufacture.

The embodiment defined in claim 19 or 20 guarantees precise and immediate control of the runner device depending on the control forces applied to the runner device by the user.

As a result of the runner embodiment defined in claim 4, stress between the top face of the runner device and a binding part or a binding plate are avoided as far as possible, which means that the runner device retains the intended flexibility characteristics as far as possible, even once the binding has been mounted.

Tension between the projections or spacing elements and the plies or layers of the runner device which they penetrate is ruled out by the embodiment defined in claim 5 or 7, which imparts a harmonious bending-characteristic to the runner device.

The embodiment defined in claim 8 prevents moisture and foreign bodies, such as ice or snow, from penetrating to the interior of the runner device, ruling out any impairment of function or damage thereto.

The embodiment defined in claim 9 imparts dynamic running properties to the runner device.

Manufacture of the runner device proposed by the invention can be made as simple as possible by the embodiment defined in claim 10 or 11 and produce the desired effects.

As a result of the features defined in claim 18, a high breaking limit of the core component can be obtained when removed, even when subjected to extreme flexing. Another advantage is that there can be no relative displacement between the two core components in the longitudinal direction of the runner device.

By integrating several separate core elements in the runner device, its mechanical properties and strength characteristics can be selectively adjusted to suit requirements. For example, a different characteristic can be imparted to the core elements on the inside part of a pair of skis than to the outwardly lying core elements of the pair of skis consisting of a left and a right ski.

A highly effective decoupling of the binding parts from the actual runner device can be achieved as a result of the embodiment defined in claim 13. As a result, the natural flexibility of the runner device is impaired as little as possible in its binding mounting region. Furthermore, a runner device of this type produces running properties similar to those of an undercarriage.

The embodiment defined in claim 14 advantageously permits the integration of core elements with relatively large crosssectional dimensions, whilst the core element to be integrated can be readily adapted to obtain the desired characteristics. Furthermore, the core elements ensure that a relatively broad range of optimum properties can be obtained.

Finally, an embodiment as defined in claim 6 is of advantage because it enables force to be transmitted as directly as possible from a core component bearing the bottom belt and/or from a shell-type top layer or from separate side walls to the steel edges and vice versa, thereby achieving optimum control behaviour.

The invention will be described in more detail below with reference to examples of embodiments illustrated in the appended drawings.

Of these:

Figure 1:
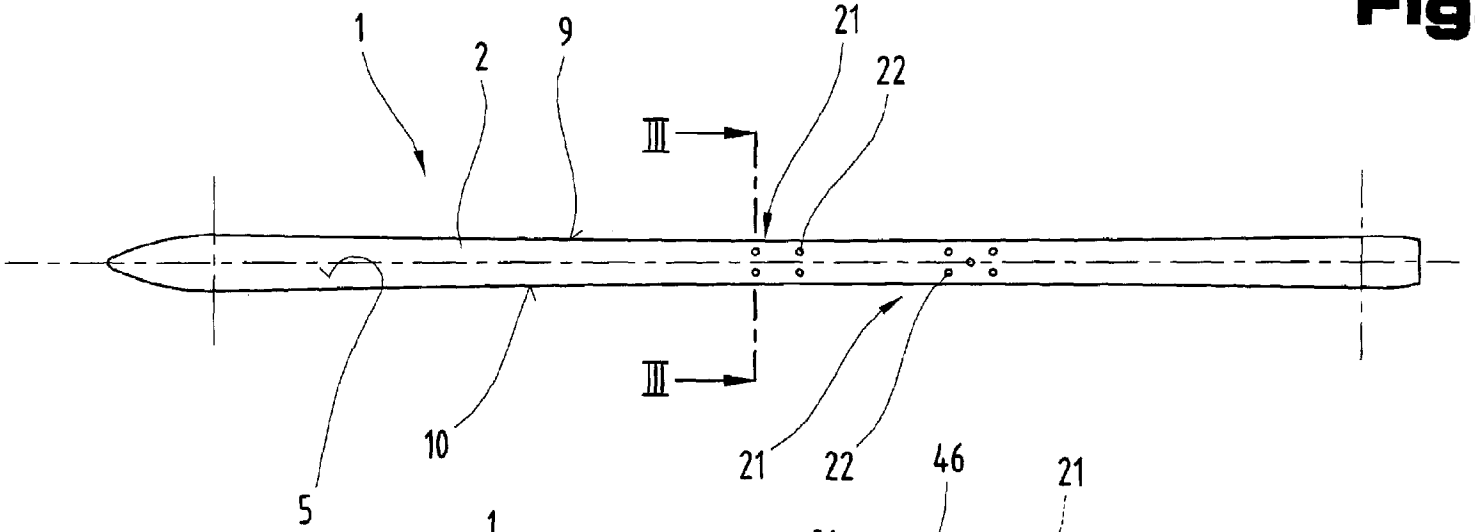
FIG. 1 is a schematic diagram in plan view, showing mounting points for a binding.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIGS. 1 to 4 show various diagrams illustrating one possible structure of a runner device 1 as proposed by the invention. The board-type runner device 1 proposed by the invention is depicted in particular as a ski 2, in an embodiment designed for alpine skiing. Alternatively, the runner device 1 might also be a snowboard, in which case the primary difference resides only in the selected ratio of length to width of the runner device 1.

Figure 3:
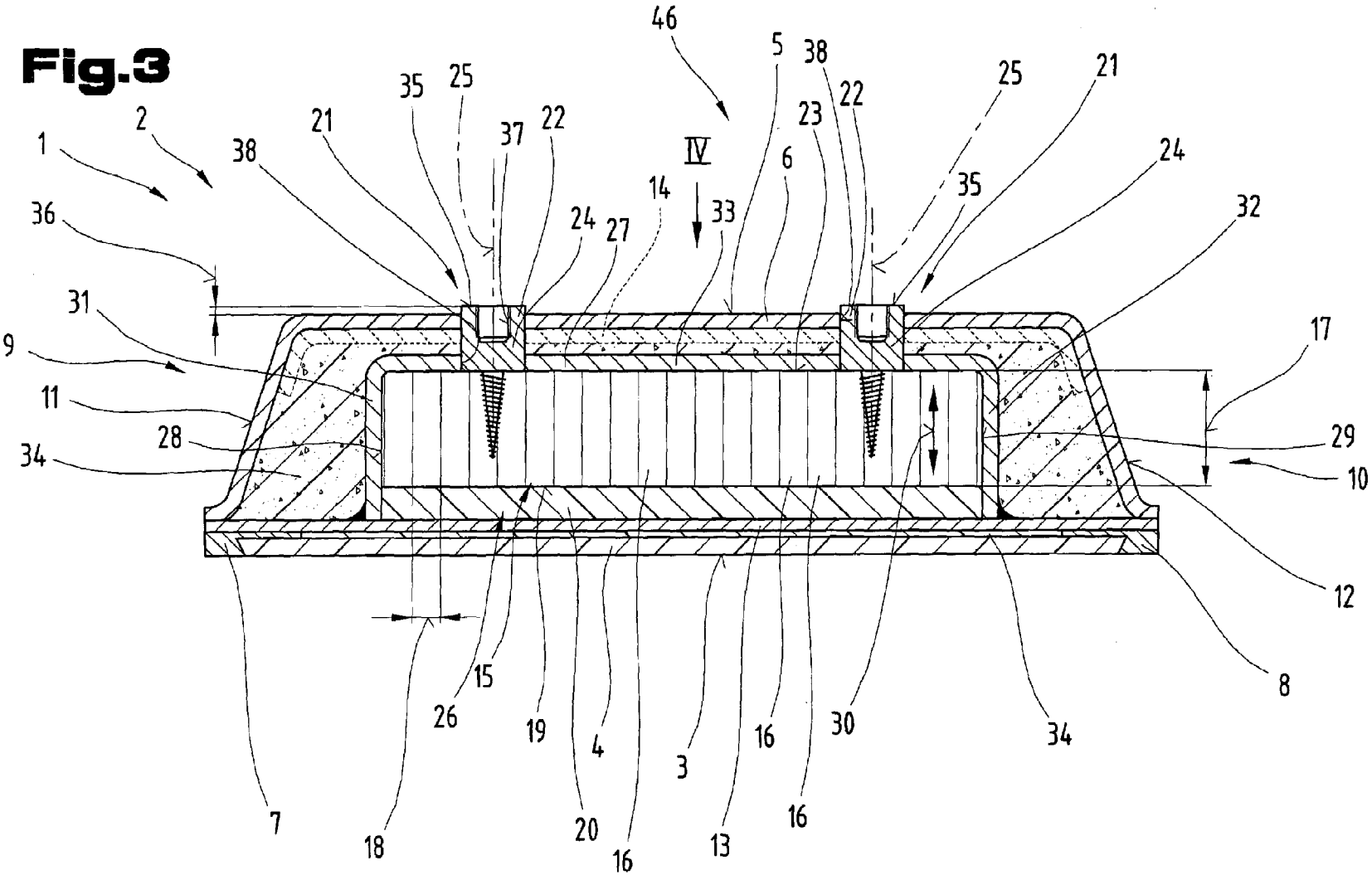
FIG. 3 is a very simplified diagram in cross section, illustrating an example of the runner device illustrated in FIG. 1, along the line III—III indicated in FIG. 1.

The runner device 1 consists of several plies or layers joined to one another in a positive fit, at least in certain regions, the underside or a running surface 3 of the runner device 1 being provided in the form of a running surface facing 4 which imparts good gliding properties, and a top face 5 of the runner device 1 in the form of a top layer 6. Bottom longitudinal side edges of the runner device 1 are provided with conventional steel edges 7, 8, thus delimiting the running surface facing 4. The top layer 6 covers at least the uppermost layer of the runner device 1, which is built as a multi-layered or sandwich element. As illustrated in FIG. 3, the top layer 6 may alternatively also extend along the longitudinal side walls 9, 10 of the runner device 1, forming side plates 11, 12 of the runner device 1. In this instance, therefore, a top layer 6 extends as a single piece in a shell-like arrangement across the uppermost layer and also forms the outer longitudinal side faces of the runner device 1.

The runner device 1 has at least one bottom belt 13 lying immediately adjacent to the running surface facing 4 and/or at least one top belt 14 of highly tensile material immediately adjacent to the top layer 6. The bottom belt 13 and also usually the top belt 14 are made from thin layers, either flat or profiled in the direction transverse to the longitudinal direction thereof, of metallic materials and/or fibre-reinforced synthetic materials or resins. Particularly if using belts of synthetic material, these will be formed by glass fibre woven fabrics impregnated with a synthetic resin, usually epoxy resin, these belts being finished by curing under pressure and temperature whilst pressing the individual layers of the ski. Belts of this type are usually made from what is referred to as prepreg. The metal materials of a bottom or top belt 13, 14 are usually aluminium or a high-tensile and lightweight aluminium or titanium alloy.

By reference to its cross section, the strip or band-type bottom belt 13 extending continuously along the entire length of the runner device 1 may also run tightly above the steel edges 7, 8 and terminate flush with the outer longitudinal side faces of the steel edges 7, 8, thereby helping to improve the transmission of force between a shell-shaped top layer 6 and the steel edges 7, 8. This being the case, the side plates 11, 12 of the shell-shaped top layer 6 are mutually supported, above the inlaid bottom belt 13, which is dimensioned to a corresponding width, directly on the top face of the steel edges 7, 8.

The bottom face of the top layer 6 usually supports a design layer which determines the optical appearance of the runner device 1 and can therefore also be termed a top or design layer.

Specifically the strip or band-shaped top belt 14 lying underneath the top layer 6 may also be of a contoured design. In particular, the cross-sectional shape of the top belt 14 may be profiled at least more or less to match the contouring of the top surface or top face 5 of the runner device 1. In the embodiment illustrated, the top belt 14 has a substantially U-shaped cross section, the two sides of which extend across only a part region of the total structural height of the runner device 1.

At least one core component 15 is provided between the bottom belt 13 and the top belt 14. This core component is arranged in the middle or at the centre of the runner device 1, whilst the plies and layers lying around it, in particular the bottom belt 13 and the top belt 14, lie in the peripheral regions of the runner device 1. The core component 15 also occupies pretty much the greater part of the cross-sectional surface of the runner device 1. In the binding mounting region of the runner device 1 in particular, the height dimension of the core component 15 occupies more than 50% of the cross-sectional height of the runner device 1. The core component 15 therefore more or less keeps the upper layers of the runner device 1, in particular the top belt 14, at a distance from the layers lying underneath, in particular the bottom belt 13.

In the embodiment illustrated, the core component 15 is made from wood. In this example of an embodiment, the core component 15 consists of a plurality of laminae 16 of an appropriate wood joined to one another, in particular bonded. The laminae 16 of the wooden core component 15 are arranged one after the other in the transverse direction of the runner device 1, aligned at the top edge, a lamina width 17 extending perpendicular to the running surface 3 of the runner device 1 and a lamina thickness 18 being that measured parallel with the running surface 3 and transversely to the longitudinal direction of the runner device 1. The lamina width 17 is therefore a multiple of the lamina thickness 18.

At least a bottom face 19 of the core component 15 rests on an elastic layer 20 in the interior of the runner device 1. The elastic layer 20 may be an elastomeric synthetic material and/or an expanded synthetic foam material with appropriate elastically resilient properties. The elastomer layer or the elastic layer 20 may have rubber-type or expanded foam-type properties and should be elastically flexible under the forces acting on it and should automatically rebound due to its natural elasticity. The elastic layer 20 may be vulcanised or expanded onto the bottom face 19 of the core component 15 or alternatively applied onto a layer lying underneath, in particular the bottom belt 13. Naturally, the elastic layer 20 may also be integrated in the runner device and core structure as a separate layer in the form of an intermediate layer.

In view of the fact that the core component 15 is supported on the elastic layer 20, it is able to be displaced relative to the surrounding layers and plies, at least slightly, in the direction perpendicular to the running surface 3 and a top face 5 of the runner device 1, if sufficiently strong forces are acting on it. In the non-operating state when nor force is being applied, the core component 15 will then automatically return to the initial or non-operating position illustrated in FIG. 3.

In particular a binding part, which for the sake of simplicity is not illustrated, to be mounted on the runner device 1 for retaining at least an end region of a user's shoe, is supported directly on this core component 15 elastically mounted in the body of the runner device 1.

The corresponding binding part may be supported by means of compression-resistant projections 21 or alternatively by means of compression-proof spacing elements 22 directly supported on a hard, inflexible top face 23 of the core component 15.

In the embodiment illustrated as an example in FIG. 3, the compression-resistant projects 21 of the core component 15 are provided in the form of separate spacing elements 22, supported directly on the top face 23 of the core component and rigidly and inflexibly joined to the latter. Positioned in a standard binding mounting region and in the centre region of the runner device 1, the projections 21 and spacing elements 22 of the core component 15 completely penetrate the top belt 14 and the top layer 6 lying on top of it, at least for the greater part, and terminate almost flush with the top face 5 of the runner device 1.

The projections or spacing elements 22 therefore act as rigid load-bearing and compression transmitting elements between the elastically mounted core component 15 and a binding part to be mounted.

The essential factor is that the projections 21 or spacing elements 22 of the core component 15 penetrate the upper layers, in particular the top belt 14 as well as the top layer 6, with sufficient clearance and are retained exclusively in the core component 15.

As may best be seen from FIG. 3, compression-proof projections 21 or spacing elements 22 are provided on the top face 23 of the core component 15 and are so preferably in the form of separate metal elements, which are permanently joined to the core component 15, in particular being screwed into the core component 15. The projections 21 or spacing elements 22 project in the form of a spacing body 24, starting from the core region of the runner device 1 in a direction perpendicular to the running surface 3 as far as the outermost top layer 6 and the projections 21 of the core component 15 terminate at least flush with the top layer 6. The spacing element 22 screwed into the core component 15 or otherwise joined to the core component 15, is also used as a mounting for schematically indicated fixing screws 25 of a binding part and/or a generally known binding plate, which amongst other things raises the standing surface. A binding plate of this type is arranged between the runner device 1 and the bottom face of the binding part to be mounted. The projections 21 or spacing elements 22 therefore form a direct, rigid coupling between the core component 15 and the corresponding binding part and/or the corresponding binding plate. The binding or the binding plate lying underneath is therefore uncoupled as far as possible from the other layers and plies of the runner device 1 and is mounted on and joined to the integrated core component 15 in an almost floating arrangement. This being the case, the binding parts of a safety ski binding, preferably in two parts, are no longer fastened or clamped to the top face 5 of the runner device 1 but can be kept free of the top face or top layer 6 by means of the projections 21 or spacing elements 2 seated directly and at least predominantly or solely on the core component 15 centrally disposed in the runner device body.

The core component 15 affording support for the binding and retaining the binding may comprise a first component of a multi-part core element 26 of the runner device. The first core component and/or the entire core element is preferably embedded in a relatively elastic synthetic material with a density of from 200 kg/m$^3$ to 400 kg/m$^3$. In particular, in addition to the first core component 15 used to retain the binding, another core component 27 may be provided. This being the case, the additional core component 27 receives the first core component 15 provided as a means of retaining the binding, at least partially, i.e. the first core component 15 is at least partially enclosed by the second core component 27. As may be seen from FIG. 3 in particular, the other core component 27 may enclose the top face 23 and longitudinal side faces 23, 29 of the first core component 15. The core components 15 and 27 forming the core element 26 are joined to one another so that they can be displaced, the maximum relative displacement path between the two core components 15 and 27 being relatively small compared with their dimensions. Under no circumstances are the core components 15, 27 bonded, screwed or positively joined to one another so as to be rigid in displacement, and instead the core component 15 and the core component 27 are permitted a limited amount of relative displacement.

Optionally, the second or outwardly lying core component 27 constitutes a form of linear guide 30 for the first or inwardly lying core component 15. The quasi core-mounted binding part can therefore be displaced by means of this linear guide 30 when the elastic layer 20 is deformed, predominantly in a direction perpendicular to the running surface 3 of the runner device 1, if correspondingly strong forces are acting via the core component 15 on the elastic layer 20. The absolutely limited and relatively restricted displacement of a binding part in a direction perpendicular to the running surface 3 is accompanied by a forcible coupling with the displacement of the first core component 15.

This linear guide 30 may be formed by designing the second core component 27 so that it extends around the inner core component 15 in a hood-type arrangement and abuts largely clearance-free with the longitudinal side faces 28, 29 of the wooden core component 15. The capacity for relative movement between the outer core component 27 and the inner core component 15 is therefore determined exclusively by the deformation resistance or modulus of elasticity of the elastic layer 20.

In the embodiment illustrated in FIG. 3, the outer core component 27 is substantially U-shaped in cross section, i.e. comprises a moulded section 33 of metal materials and/or of synthetic materials with legs 31, 32 extending out at an angle from a base plate. The longitudinal side edges of this moulded section 33 may be at least partially joined to the top face of the bottom belt 13 in a positive fit arrangement, as schematically indicated by bonding or weld spots, and can therefore be made as a prefabricated element 26 for a runner device 1.

The essential factor is that the outer longitudinal side faces 29, 30 of the internally lying core component 15 and the internal faces of the externally lying core component 17 co-operating with them are not rigidly joined to one another or bonded to one another but are left so that relative displacements are permitted between the core component 15 and the core component 27 against the mechanical deformation resistance of the elastic layer 20.

Merely for the sake of completeness, it should be pointed out that the projections 21 or spacing elements 22 also completely penetrate the outer core component 27, in particular the moulded section 33, with sufficient clearance for the projections 21 or spacing elements 22 to be supported directly on the inner core component 15. These bores for unhindered insertion of the projections 21 or spacing elements through the outer core component 27 also prevent any direct stress occurring between the inner and the outer core components 15 and 27 in the longitudinal direction of the runner device 1 if the entire core element 26 is flexed or bent.

The bottom belt 13 and the outer core component 27 with the core component 15 received in between and the elastic layer 20 on the bottom face 19 thereof may also form a prefabricated separate core element 26, which can be readily incorporated in a manufacturing process for the runner device 1. In particular, the prefabricated, multi-part core element 26 may be easily pressed under pressure and temperature with the other supporting layers and plies to produce a runner device 1.

Merely for the sake of completeness, it should be pointed out that the individual components and layers of the runner device 1 are joined to one another by appropriate adhesive or filler layers 34 to form an integral multi-layered or sandwich element, and are bonded in particular. Individual cavities between the various layers and components may also be largely filled by means of these adhesive or filler layers 34.

The core element 26, in particular the core component 15 and/or the core component 27, extends almost across the entire length of the runner device 1 and therefore acts as an element which provides a relatively broad distribution of the supporting and bearing forces, which may be localised to a greater or lesser degree, generated by the binding across the length of the runner device 1. The core component 15 arranged in an almost floating mounting arrangement in the innermost or centre region of the runner device 1 with the mounting options for binding parts provided in the form of the projections 21 or spacing elements 22 are conducive to the running properties of the runner device 1 to a surprisingly high and unforeseeable degree. In particular, the runner device 1 provides the best running properties in terms of sliding action because of the elastically mounted core component 15 and the runner device 1 also has an optimum flexural strength characteristic which is significantly less impaired by mounted binding parts and a shoe clamped in between than is the case with conventional structures. This is due, firstly, to the fact that the binding is no longer anchored by the outermost layers of the runner device 1 which provide the support function and are responsible for the stiffness of the runner device 1 but are uncoupled from these layers and plies in the outer peripheral region of the runner device 1 as far as possible because of the core support system. In effect, the core component 15 has hardly any effect on the flexural strength of the runner device 1 compared with the peripheral layers and the top belt 14, the neutral fibre of the runner device 1 also running in the core element 26 and in the core component 27. The intrinsic dynamic properties of the runner device 1 are therefore impaired as little as possible by the virtually core-mounted binding.

Moreover, in order to obtain a flexural curve for the runner device 1 that is even less affected by the binding parts, a support surface 35 for the corresponding binding plate and/or a corresponding binding part is formed on the respective projections 21 or spacing elements 22 at a distance 36 above the top face 5 of the runner device 1. As a result, a clearance is left free between the bottom face of the corresponding binding part or the corresponding binding plate and the top face 5 of the runner device 1. This clearance in the form of the distance 36 firstly ensures that there is a sufficient displacement or damping path in the direction perpendicular to the running surface 3. In addition, the clearance left free by the distance 36 between the binding part and the runner device 1 provides compensation for displacements of the runner device 1 that are as unimpeded as possible. The distance 36 may in effect be approximately 0.5 mm up to 5 mm.

Figure 4:
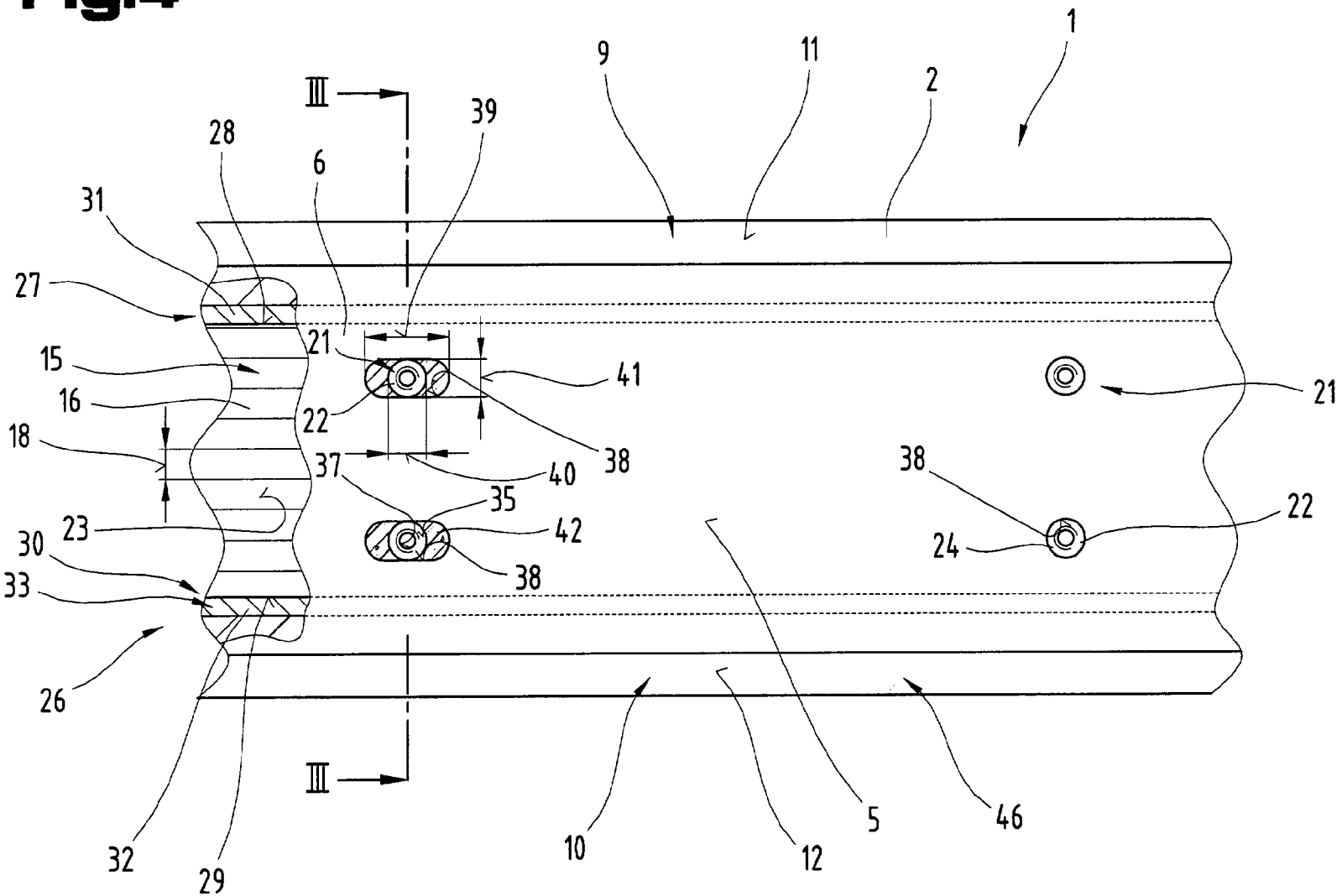
FIG. 4 shows a part region of the runner device for mounting a binding part, seen in plan view in the direction indicated by arrow IV in FIG. 3.

As may best be seen from FIG. 4, four or five projections 21 and spacing elements 22 are provided for every binding part to anchor fixing screws, not illustrated, for a binding plate or a binding part. As clearly illustrated, the projections 21 and spacing elements 22 are post-type elements with a relatively small cross-sectional surface, seated directly on the core component 15. In the embodiment illustrated as an example, the projections 21 and spacing elements 22 have circular support surfaces 35 for a binding plate or for a corresponding binding part. At least one bore 37 is provided in the middle region of the support surface 35 for anchoring the fixing screws 25.

The projections 21 and spacing elements 22 thus project starting from the core component 15 through respective co-operating bores 38 in the top belt 14, in the top layer 6 and under certain circumstances also in the second core component 27 at least as far as the top face 5 of the runner device 1.

A length 39 measured in the longitudinal direction of the runner device 1 starting from the outer bores 38 immediately adjacent to the peripheral region of the binding mounting region is greater than an external width 40 of the respective projection 21 or spacing element 22 measured in the same direction. Consequently, this guarantees that there is sufficient clearance between the projection 21 and the spacing element 22 and the layers penetrated by them.

An external width 41 of the projections 21 and spacing elements 22 measured transversely to the longitudinal direction of the runner device 1 corresponds more or less to the width of the bores 38 so that the projections 21 and spacing elements 22 are fixed so as to be non-displaceable in the transverse direction of the runner device 1.

The clearance left free in front of and behind the projections 21 and spacing elements 22 between the front and rear boundary surface of the projection 21 or spacing element 22 and the wall faces of the respective bore 38 spaced at a distance apart therefrom is preferably at least partially filled with a relatively soft elastomer 42.

The projections 21 and spacing elements 22 lying to the inside or immediately adjacent to the centre of the binding mounting may open by means of bores 38 from the core region of the runner device 1 adjoining the external surfaces of the projections 21 and spacing elements 22 as closely as possible, since there is barely any need for compensating movements in the region at the centre of the binding mounting when the ski flexes.

Optionally, it is also possible for corresponding binding plates to be mounted ready for use on the work end of the projections 21 and spacing elements 22. The binding parts can then be retained or secured to these binding plates in a position corresponding to the required shoe size.

Figure 2:
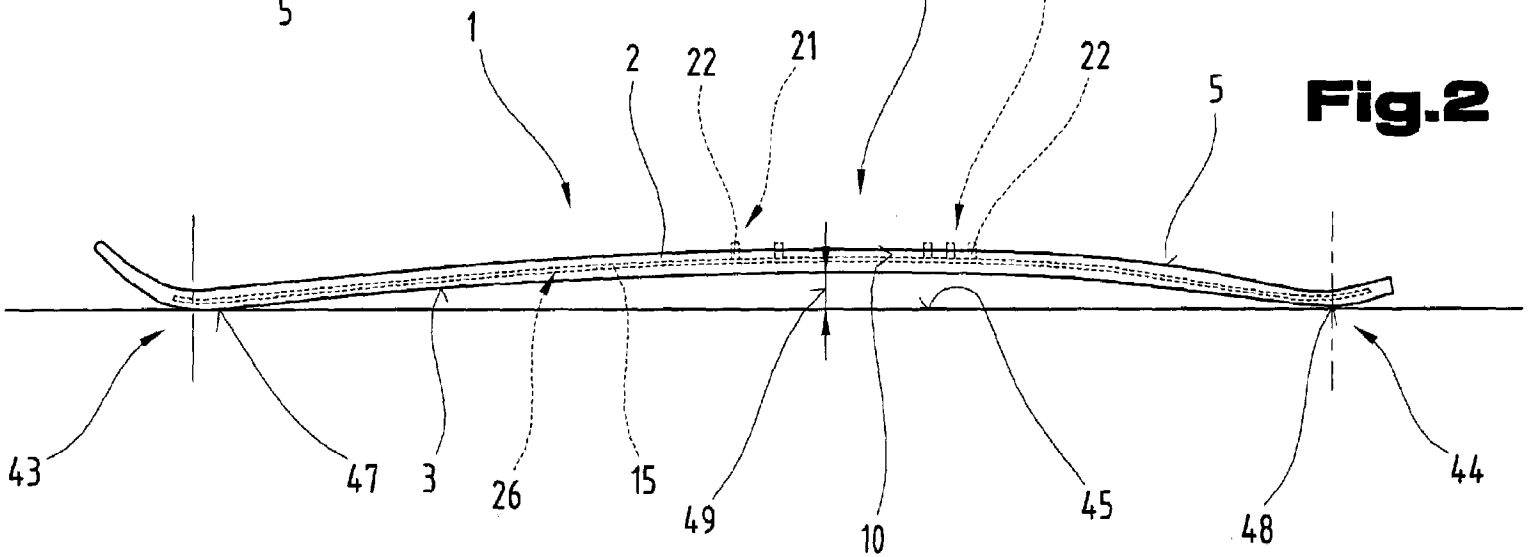
FIG. 2 is a side view of the runner device illustrated in FIG. 1, with a very simplified illustration of the design of the binding mounting.

As may be seen with particular clarity from FIG. 2, at least the multi-part core element 26 or alternatively the core element 15 provided as a means of supporting the binding parts may extend continuously between a front and rear contact region 43, 44 with flat underlying ground 45 when no load is being applied to the runner device 1. In particular, the core element 26 and the core component 15 for mounting the binding extend from the binding mounting region 46 of the runner device 1 as far as the region of contact zones 47, 48 of the running surface 3 with flat underlying ground 45 when no load is placed on the runner device 1. As seen in side view, the runner device 1 is upwardly cambered in a bow shape across the greater part of the longitudinal region and in the unloaded state has a specific degree of pre-tensioned height 49 between the running surface 3 and a flat underlying ground 45. The core component 15, respectively the core element 26 therefore extends in a bridge-type arrangement between the contact zones 47, 48 with flat underlying ground 45 at the two end regions of the runner device 1.

If two core components 15, 27 are used, inserted one inside the other, the outer core component 27 also preferably extends continuously as far as the contact zones 47, 48 in the end regions when no load is placed on the runner device 1.

Figure 5:
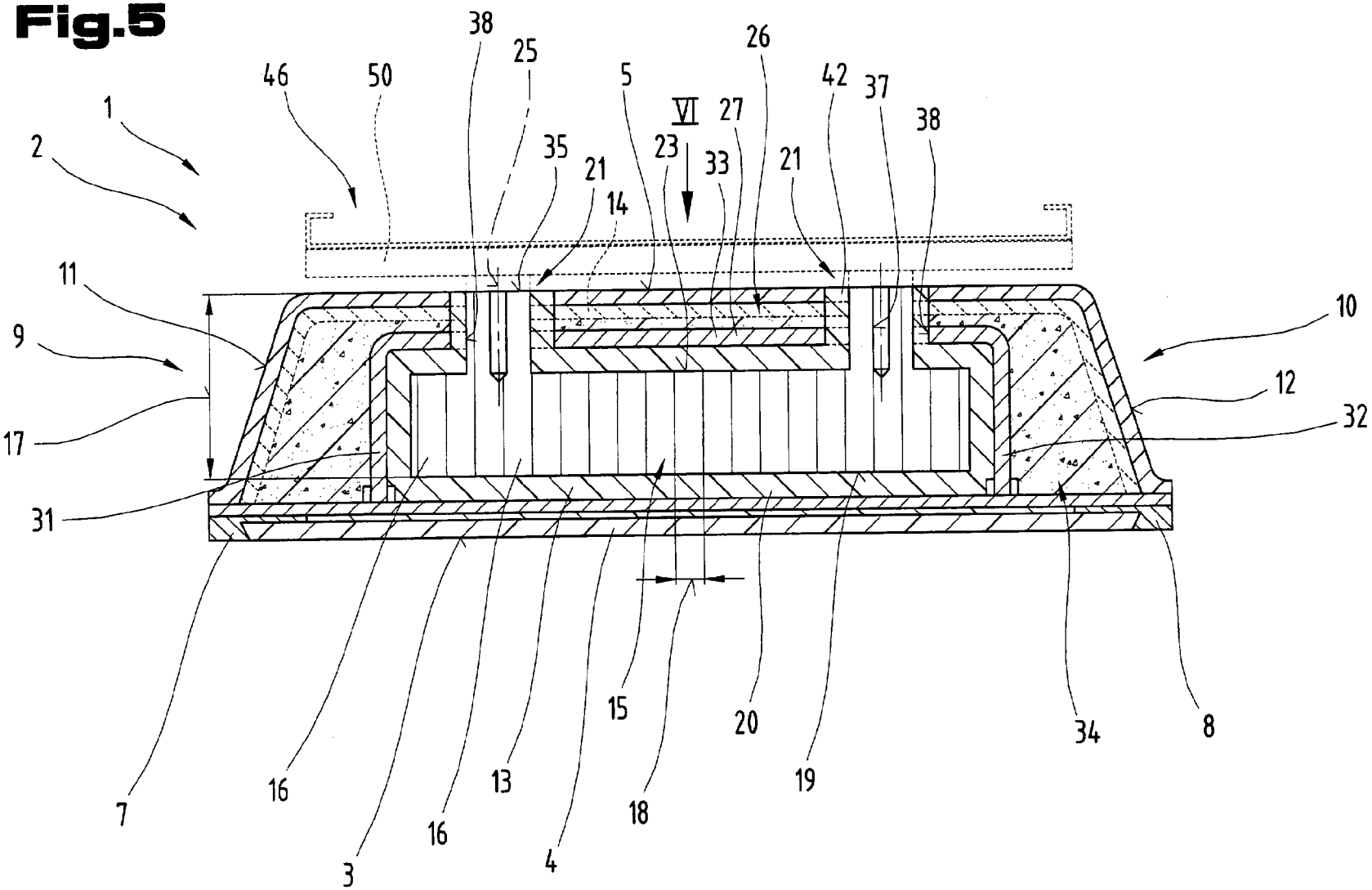
FIG. 5 is a simplified schematic diagram, seen in cross section, showing another embodiment of a runner device with a binding mounting.
Figure 6:
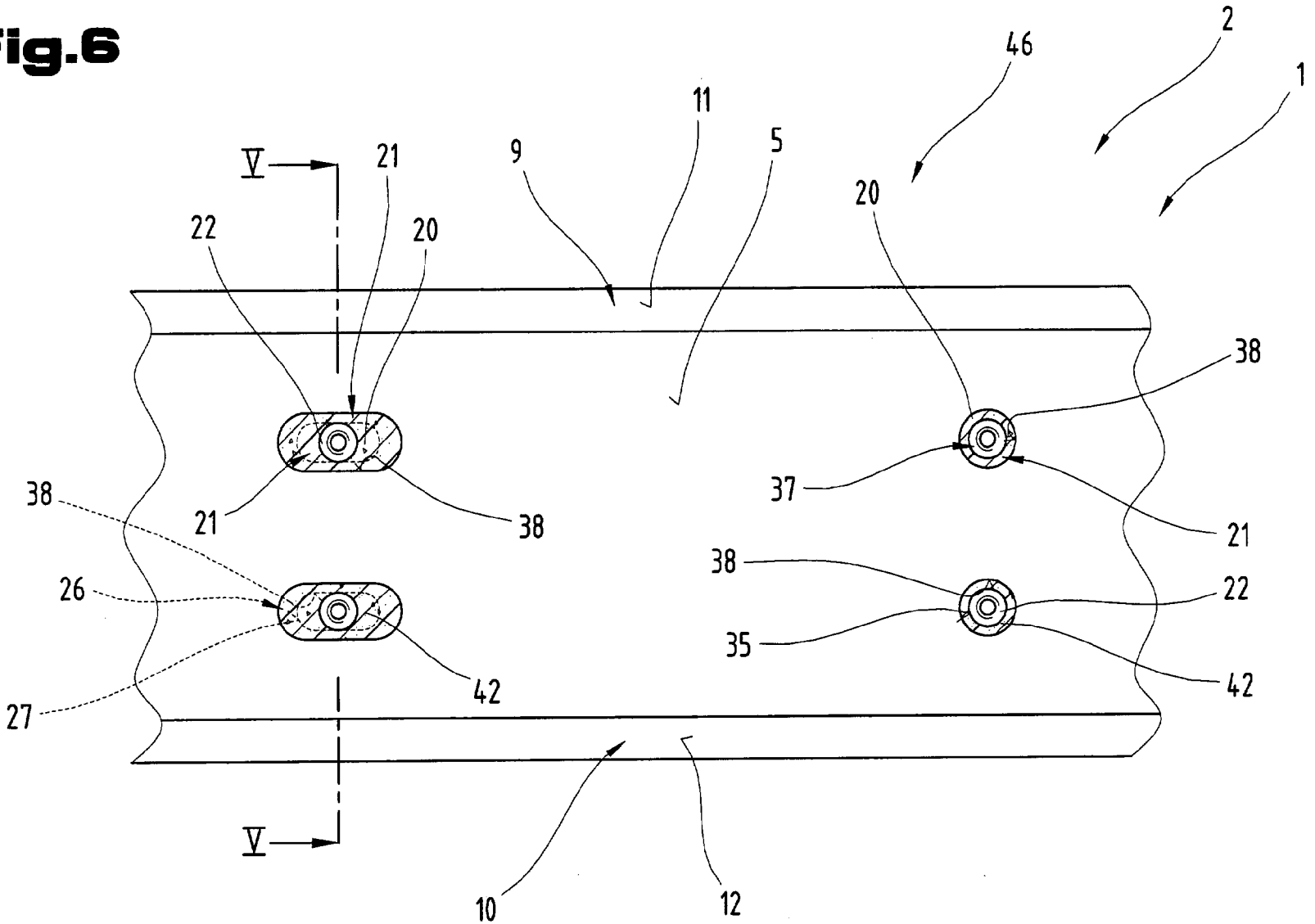
FIG. 6 is a plan view of the binding mounting region for a binding part and the runner device viewed in the direction of arrow VI indicated in FIG. 5.

FIGS. 5 and 6 illustrate another embodiment of the runner device 1 providing a core-mounting for binding parts. The same reference numbers are used for parts already described above and the descriptions given above may be transposed to same parts denoted by same reference numbers here.

The essential difference resides in the fact that the projections 21 projecting from the core component 15 as far as a level at least flush with the top face 5 of the runner device 1 are formed as an integral piece with the core component 15. The projections 21 may therefore be provided in the form of land or post-type elements standing proud of the top face 23 of the integrated core component 15. The projections 21 forming an integral unit with the core component 15, intended to provide direct support for the binding, may also be made by milling processes applied to a workpiece constituting a core component 15. However, the core component 15 could also be made by a casting or injection-moulding process enabling the projections 21 to be integrally moulded.

As may best be seen from FIG. 5, the core component 15 may again be made up of a plurality of laminae 16 made from wood. Individual laminae 16 will then have a larger lamina width 17 than the other laminae of the core component 15 and thus form the projections 21 of the core component 15. This specifically enables post-type projections 21 to be formed in the binding mounting region 46 provided on the top face 23 of the core component 15. The schematically indicated fixing screws 25 for a binding plate 50 or for a binding part can be screwed into these post-type projections 21 and anchored in the core component 15.

In order to produce the pedestal-type or post-type projections 21 specifically illustrated in FIG. 6, the middle regions of the land-type raised areas can be readily removed, in particular milled down, leaving raised areas with only a small surface area in the region where the anchoring points are provided for the fixing screws 25, leading directly into the core region of the runner device 1.

Another difference resides in the fact that the core element 15 is enclosed around virtually the entire circumferential region, in particular on all sides, by the elastic layer 20. Only the support surfaces 35 for the binding parts on the projections 21 of the core component 15 are not covered by the elastic layer 20. In particular, the elastic layer 20 also extends through the bores 38 in the top belt 14 and the top layer 6 and thus encloses the entire circumference of the outer or external surfaces of the post-type projections 21.

With this embodiment, therefore, the core component 15 in the centre region of the runner device 1 is mounted in a floating arrangement in all spatial directions. Consequently, all external surfaces of the core component 15 are enclosed or covered by the elastic layer 20. Shearing, torsional and deformation forces are transmitted between the inner core component 15 and the outer core component 27 exclusively via the elastic layer 20.

The outer core component 27 is again enclosed by the elastic layer 20 in a hood-type arrangement. The core component 27 also has orifices 38 to enable the projections 21 to penetrate the internally lying core component 15.

The outer core component 27 or moulded section 33, which is substantially U-shaped in cross section, may be joined to the bottom belt 13 by means of the longitudinal side edges of the two sides 31, 32 directed away from the base plate, in particular welded or bonded. The middle part-region of the flat bottom belt 13 and the base plate of the U-shaped moulded section 33 spaced at a distance by means of the sides 31, 32 therefore form a mounting compartment for the core component 15 with the projections 21, which is similarly mounted in the elastic layer 20 in a virtually floating arrangement.

In the embodiment illustrated as an example, the runner device 1 has a substantially trapezoidal cross section and the cross-sectional shape of the top belt 14 is therefore adapted to this trapezoidally-shaped cross section. In addition, the top belt 14 is supported at its longitudinal side edges in the longitudinal regions of the bottom belt 13 close to the steel edges 7, 8.

As may be seen most clearly from FIG. 6, the elastomer layer 20 emerges from the core region of the runner device 1 and terminates at least flush with the top face 5 of the runner device 1.

Also clearly visible in FIG. 6 is the fact that the elastic layer 20 extends out from the interior of the runner device 1 and externally surrounds all projections 21, namely including the projections 21 lying to the inside of the binding mounting region 46. This is achieved due to the fact that the orifice widths of the bores 38 are larger than the respective width and length dimensions of the penetrating projections 21.

Figure 7:
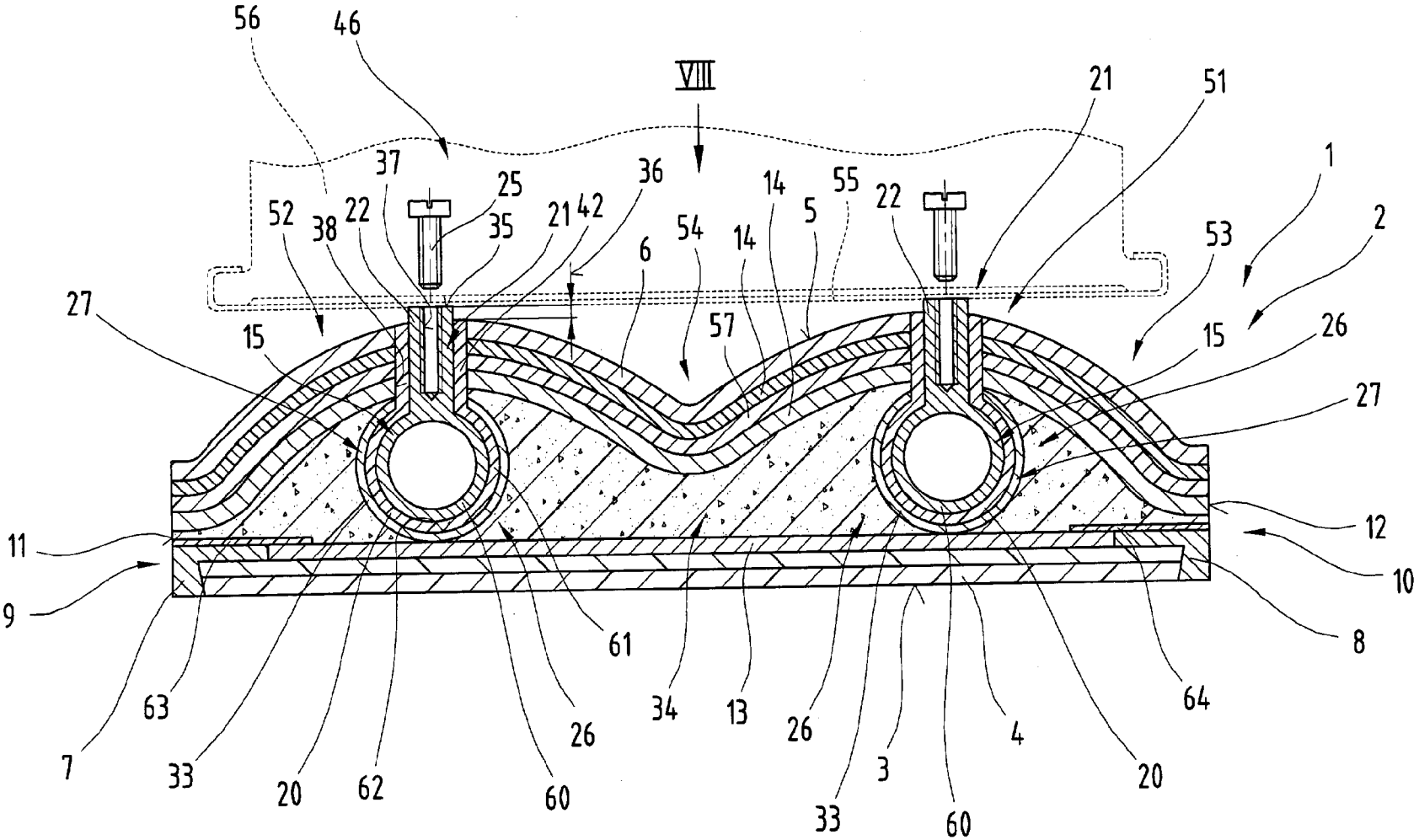
FIG. 7 is a simplified diagram in cross section of another embodiment of a runner device with a binding mounting.
Figure 8:
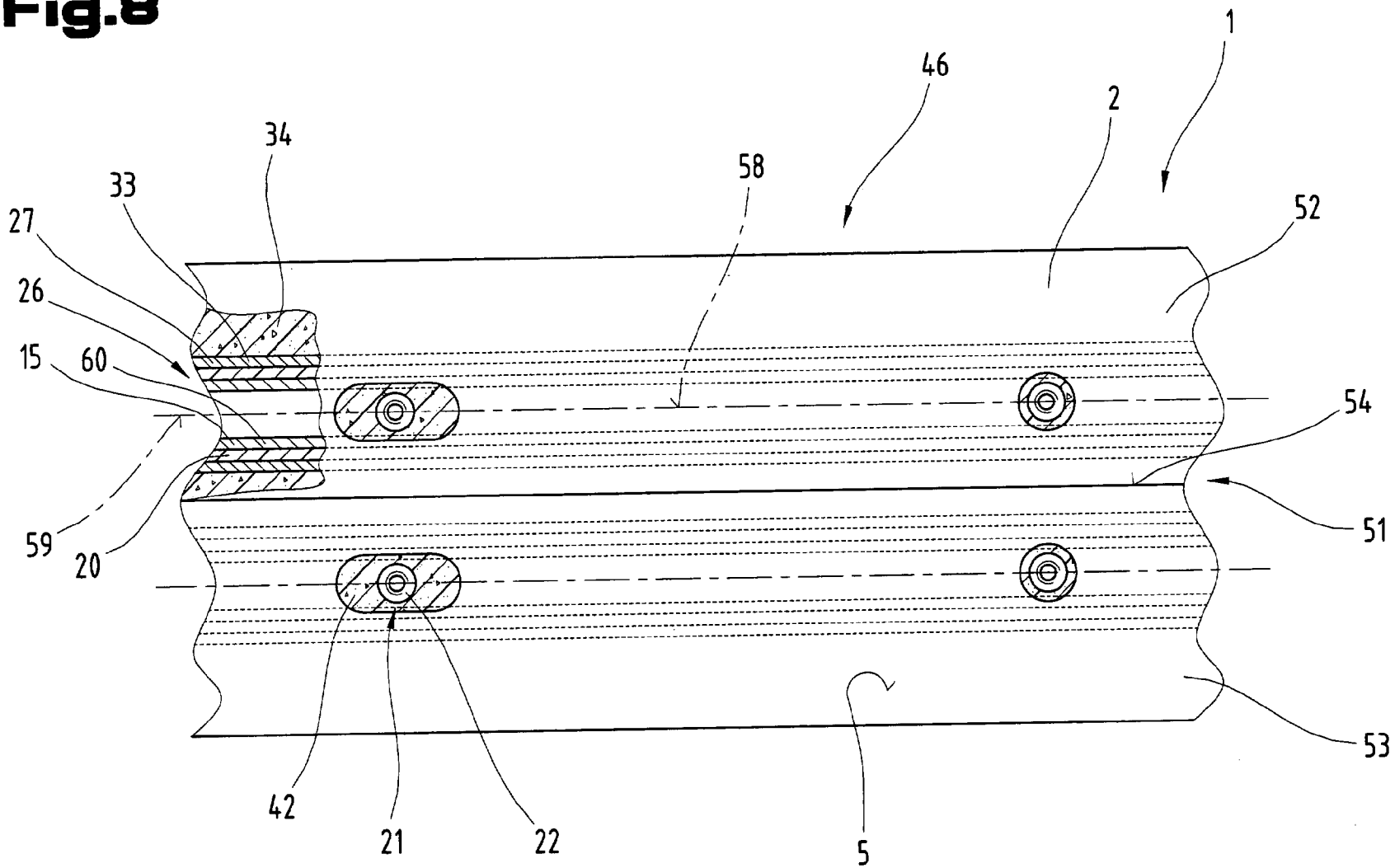
FIG. 8 is a plan view in the direction of arrow VIII of FIG. 7, showing the mounting region for mounting a binding part of the runner device.

FIGS. 7 and 8 illustrate another advantageous embodiment for mounting and retaining a binding part, for example a ski binding or optionally a snowboard binding. The same reference numbers are used to denote parts already described above and the above descriptions can be transposed in terms of meaning to same parts bearing the same reference numbers.

By contrast with the embodiments described above, the board-type runner device 1 illustrated here has a top face 5 with contouring 51 or shaping. In particular, at least two bead-type raised areas 52, 53 with a recess 54 lying in between extend in the longitudinal direction of the runner device 1. Consequently, at least two bead-type mounds extend in the longitudinal direction of the runner device 1, which impart a wave-shaped top edge or top face 5 to the runner device 1 when the runner device 1 is viewed in cross section.

This contouring 51 of the runner device top face is provided at least in the central region of the runner device 1. The raised areas 52, 53 may extend close up to the end regions or close up to the contact points 43, 44 with flat underlying ground 45 when no load is placed on the runner device 1 as illustrated in FIGS. 1 and 2. Starting from the middle region of the runner device 1 towards the end regions thereof, the raised areas 52, 53 become continuously flatter and gradually merge into a flat top face 5 in the tip and end regions of the runner device 1.

In the embodiment illustrated as an example here, the contouring 51 of the runner device 1 also extends within the binding mounting region 46. Naturally, it would also be possible for the binding mounting region 46 to be designed as a largely flat mounting zone for a mounting rail 55 or for a binding part 56. The contouring 51 of the runner device 1 will then run from the two ends of a flat binding mounting region 46 as far as the respective end regions of the runner device 1. Consequently, the binding mounting region 46 in this case forms a plateau-like flat mounting zone for a binding plate 50 and/or for mounting rails for retaining binding parts 56.

Instead of a cross section with arcuately designed raised areas 52, 53, it would naturally also be possible to provide the top face 5 of the runner device 1 with any other contouring, which can advantageously be used to retain the binding or mount the binding in the manner proposed.

As may be seen primarily from FIG. 7, the runner device 1 may also have significantly more than two layers or plies above the at least one core element 26. In the embodiment illustrated as an example here, at least two separate, relatively hard layers of the top belt 14 are disposed underneath the top layer 6. A relatively soft elastomeric intermediate layer 57 may be provided between these relatively hard layers forming part of the top belt 14. The top and bottom face of this elastic intermediate layer 57 is joined in a positive connection to one of the relatively hard and highly tensile layers of the multi-layered top belt 14 by means of a bonding or vulcanisation process, for example. Consequently, all shearing, compression, tensile and torsional forces will be transmitted from the upper layer of the top belt 14 to the lower layer of the top belt 14 and vice versa via this elastic intermediate layer 57. The hard layers of the top belt 14 may also be made from different materials. In particular, the upper layer of the top belt 14 may be made from a metal material, whilst the lower layer of the top belt 14 may be predominantly of synthetic material, for example resin-impregnated woven fabrics.

What is also significantly different about this embodiment of the runner device 1 is that two separate core elements 26 are integrated in the interior of the runner device 1, extending in the longitudinal direction of the runner device 1.

These two core elements 26 run substantially parallel and are congruent with the respective bead-type raised areas 52, 53 of the runner device top face. By preference, the integrated core elements 26 are arranged substantially centred relative to an imaginary crest line 58 of the respective raised area 52, 53 extending in the longitudinal direction of the runner device 1. In particular, an imaginary longitudinal mid-axis 59 of a core element 26 as seen in a plan view onto the runner device 1 is aligned so as to be substantially congruent with the respective crest line 58 of the corresponding raised area 52, 53, as may best be seen from FIG. 8. Since the raised areas 52, 53 of the runner device 1 make for a quite generous spatial arrangement, the respective core elements 26 may have relatively large cross-sectional dimensions or cross-sectional heights and can nevertheless integrated in the runner device structure without problem.

The crest line 58 links the crest points of the respective arcuately shaped raised areas 52, 53 at separate cross-sectional regions of the runner device 1 spaced at a distance apart from one another in the longitudinal direction of the runner device 1 and can therefore also be defined as a backbone or the uppermost boundary line between the curved surface regions of a raised area 52 or 53.

Each multi-part core element 26 again consists of an outer moulded section 33, which at least partially surrounds or encloses the inner core component 15. In the case of this embodiment, the inner core component 15 is similarly provided in the form of a moulded section 60. The inner moulded section 60 and the outer moulded section 33 have the same or at least similar shapes of cross section, but the cross-sectional dimensions of the inner moulded section 60 will naturally have to be smaller.

In a preferred embodiment, the moulded sections 33 and 60 inserted one inside the other are substantially circular in cross-sectional shape. In particular, these moulded sections 33 and 60 assembled with one another to make up a multi-part core element 26 are provided in the form of tubes. To adapt these moulded sections 33, 60 more closely to the standard contour of the cross-sectional height of the runner device 1, the moulded sections 33, 60 may become increasingly flat, starting from their mid-region towards their end regions or in the direction towards the end regions of the runner device 1. The moulded sections 33, 60 may also be flat in their end regions or in the end regions of the runner device 1, to the degree that their ends are compressed totally flat, thereby closing off the core element 26 in its end regions, Naturally, it would also be possible to provide separate closure caps or closure stoppers in the end regions of the moulded sections 33, 60 or in the end regions of the multi-part core element 26, so that a hollow core element 26 is closed off from the outside in.

Instead of using hollow, tubular core components 15 and 27 for a multi-part core element 26, it would naturally also be possible to use moulded sections 33 and 60 with a different cross section. For example, the moulded sections 33, 60 could also have a square, rectangular, triangular, trapezoidal or elliptical cross section or be of any other combined cross sectional shape. By preference, the upper shell region of the assembled core element 26 should be at least more or less adapted to the surface contour or contouring 51 of the final runner device 1. By ensuring that the upper outer surface of the outer moulded section 33 and the core element 26 at least more or less conforms to the contouring 51 of the top face 5 of the runner device 1, optimum use can be made of the relatively tight amount of available space, which is also constrained by the standard dimensions of the runner device. In addition, the static and mechanical properties obtained for the runner device 1 are also favourable.

Instead of a hollow inner moulded section 60, it would naturally also be possible for a solid body to be used for the inner moulded section 60, in particular a flexible bar or a corresponding rod, in which case a part such as this would be inserted in the outer moulded section 33 and would for the most part be enclosed by the outer moulded section 60. The external dimensions, in particular the cross-sectional width and the cross-sectional height, of the inner moulded section 60 are selected so that it can be inserted in the outer moulded section 33 with some clearance and so that the moulded section 60 can be nested with the moulded section 33.

This clearance between an external face 61 of the inner moulded section 60 and an internal face 62 of the outer moulded section 33 is in turn at least partially filled with an elastic layer 20. The elastic layer 20 is therefore arranged between the external face 61 of the inner core component 15 and the internal face 62 of the outer core component 27 constitiuing a mounting or enclosure for the inner core component 15. This elastic layer 20 keeps the inner core component 15 and the inner moulded section 60 at a distance from the internal surface 62 of the outer core component 27 or at a distance from the corresponding moulded section 33, this unit consisting of a first core component 15, a second core component 27 with an elastic layer 20 inserted in between, thereby providing a single-piece core element 26 made up of multiple parts. This multi-part core element 26 constitutes a flexible bar with ideal static characteristic values and dynamic bending properties which can be readily integrated in the runner device 1.

The profiled section 33 or 60 is preferably made from a metal material. Particularly suitable are moulded sections 33, 60 made from aluminium or a highly tensile and light-weight aluminium or titanium alloy. Naturally, it would also be possible to make these moulded sections 33 and 60 from synthetic materials and/or as elements with individual woven fibres or filaments reinforced with binders and integrated in the runner device 1.

In the embodiment illustrated, the projections 21 for mounting fixing screws 25 for a binding plate 50 and/or for a mounting rail 55 and/or for a corresponding binding part 56 are moulded directly onto the inner core component 15 or directly onto the corresponding inner profiled section 60. These projections 21 on the inner moulded sections 60, mounted so that vibrations will be damped by the elastic layer 20, penetrate the outer moulded section 33 and the layers of the top belt 14 by means of bores 38 in these elements. As may also be seen, the inner core component 15 or the inner moulded 60 section penetrates the outer moulded section 33 and the supporting top belt 14 in a mounting region provided for fixing screws 25 for binding parts 56.

Instead of integral projections 21 moulded onto the inner moulded section 60 illustrated here, it would naturally also be possible to provide a bush-type spacing element 22 on the top face of the inner moulded section 60, loosely penetrated by a matching fixing screw 25. This being the case, the tip of the fixing screw 25 will be anchored exclusively in the inner core component 15 and will apply the spacing bush against the top face of the elastically mounted core component 15 due to the pre-tensioning generated between binding part and core component 15. In an embodiment of this type, the moulded section 60 will have relatively thick walls or will be provided in the form of bearings in order to produce a firm anchor for the fixing screws 25 in the core component 15. However, the fixing screws 25 can be secured quite firmly to prevent them from being torn out if the projections 21 are moulded onto the inner moulded section 60 and fixing screws 25 anchored directly in the material of the projections. In this case, the bores 37 which receive the fixing screws 25 will be blind bores. By contrast with the illustrated embodiment, it would naturally also be possible for the bores 37 to be continuous bores leading directly into the cavity of the inner moulded section 60.

In the embodiment illustrated as an example here, the two elongate core elements 26 keep the layers of the bottom belt 13 spaced apart from the layers of the top belt 14. In particular, the bottom belt 13 sits directly against the underside of the outer moulded section 33 and a bottom face of the top belt 14 also sits directly on the facing top face of the outer moulded section 33. The free space left between the core elements 26 and the bottom or top belt 13 is filled with a layer of adhesive or filler 34. This layer of adhesive or filler 34 may also be an expanded synthetic material, in which case it might be termed a foam core. The core element 26 may be joined to the bottom and top belt 13, 14 in a positive fit, at least within part regions of the contact points, and may be so by bonding or welding in particular.

The adhesive or filler layer 34 in the core region of the runner device is preferably provided in the form of a relatively lightweight expanded synthetic material, which may also have permanent elastic properties.

As may be seen in particular from FIG. 7, the longitudinal side walls 9, 10 of the runner device 1 are formed amongst other things by separate side wall elements 63, 64 varying in thickness or height, which constitute the transition between the lower layers and the upper layers of the runner device 1 and the side plates 11, 12 of the runner device 1.

Figure 9:
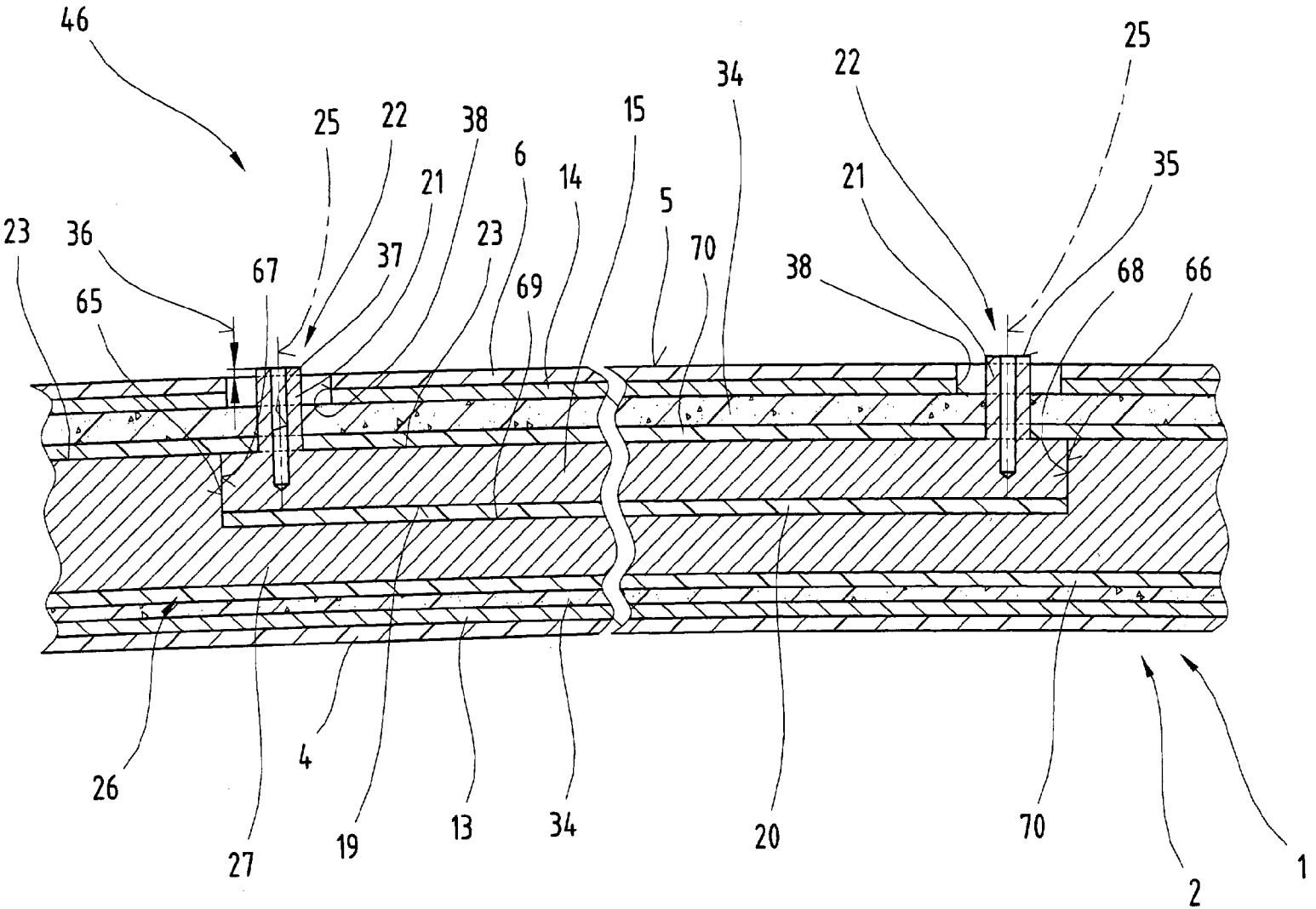
FIG. 9 is a simplified, schematic diagram in longitudinal section through a runner device in the region of the mounting point for a core-mounted binding part.

FIG. 9 illustrates a different embodiment used for retaining or mounting a binding part on a runner device 1. The same reference numbers are used for parts already described above and the above descriptions may be transposed in terms of meaning to same parts bearing the same reference numbers.

In this case, the core component 15 for the binding mounting extends solely within the standard binding mounting region 46 and end faces 65, 66 of this core component 15 sit largely without any clearance adjoining boundary surfaces 67, 68, spaced at a distance apart from one another in the longitudinal direction of the runner device 1, of a recess 69 in the core component 27.

The dimensions of this recess 69 in the top face 23 of the core component 27 are selected so that the core component 15 which retains the binding can be accommodated at least partially therein. In the embodiment illustrated, the depth of the recess 69 is approximately half the core component 27. The elastic layer 20 is again provided between the bottom face 19 of the core component 15 and the base of the recess 69. As a result, the core component 15 used to mount the binding is mounted so that it can be displaced in the direction perpendicular to the top face 5 of the runner device 1 and the deforming motion of the elastic layer 20.

In view of the fact that the end faces 65, 66 and boundary surfaces 67, 68 sit tight against one another with virtually no clearance, the core component 15 is fixed so that it can not be displaced in the longitudinal direction of the runner device or in the longitudinal direction of the core component 27.

The core component 15 again bears projections 21 and/or optionally corresponding spacing elements 22, which stand on the top face 23 of the core component and extend at least as far as the top face 5 of the runner device 1. Matching bores 38 or oblong holes are provided for this purpose in the layers of the runner device 1 above the core components.

In the embodiment illustrated, only the projections 21 lying totally outside the binding mounting region 46 are shown, the middle projections used to anchor the middle fixing screws 25 being left out of the drawing. As may be clearly seen from FIG. 9, the bores 38 lying in the peripheral regions of the binding mounting region 46 are provided in the form of oblong holes pointing in the longitudinal direction of the runner device 1.

As may also be seen from FIG. 9, the multi-part core element 26 is surrounded by an elastic sheath 70, which enables the multi-part core element 26 to be embedded in the runner device structure in an elastically flexible arrangement. This elastic sheath may be a sheath 70 made from an elastomeric rubber material or expanded synthetic material.

The sheath 70 enables motion caused by lifting of the core component 15 from the core component 27 to be damped.

The design of the projections 21 integral with the core component 15 integrated in the runner device body enables fixing screws 25 for binding parts 56 to be anchored very securely since the fixing screws can be anchored across an extensive region along the height of the projections 21 and the height of the core component 15. In particular, this design means that the fixing screws need not also penetrate the outer core component 27, which would mean forfeiting the intended damping function and the intended longitudinal compensation between the core components 15 and 27.

For the sake of good order, it should finally be pointed out that in order to provide a clearer understanding of the structure of the runner device 1, it and its constituent parts have been illustrated out of scale to a certain extent and/or on an enlarged and/or reduced scale.

Above all, subject matter relating to the individual embodiments illustrated in FIGS. 1, 2, 3, 4; 5, 6; 7, 8; 9 can be construed as independent solutions proposed by the invention. The tasks and solutions can be found in the detailed descriptions relating to these drawings.

List of reference numbers

| | |
|---|---|
| 1 | Runner device |
| 2 | Ski |
| 3 | Running surface |
| 4 | Running surface facing |
| 5 | Top face |
| 6 | Top layer |
| 7 | Steel edge |
| 8 | Steel edge |
| 9 | Longitudinal side wall |
| 10 | Longitudinal side wall |
| 11 | Side plate |
| 12 | Side plate |
| 13 | Bottom belt |
| 14 | Top belt |
| 15 | Core component |
| 16 | Lamina |
| 17 | Lamina width |
| 18 | Lamina thickness |
| 19 | Bottom face (of the core component 15) |
| 20 | Layer (elastic) |

-continued

| List of reference numbers | |
|---|---|
| 21 | Projection |
| 22 | Spacing clement |
| 23 | Top face (of the core component 15) |
| 24 | Spacing body |
| 25 | Fixing screw |
| 26 | Core element (multi-part) |
| 27 | Core component |
| 28 | Longitudinal side face (of core component 15) |
| 29 | Longitudinal side face (of core component 15) |
| 30 | Linear guide |
| 31 | Side |
| 32 | Side |
| 33 | Moulded section |
| 34 | Adhesive or filler layer |
| 35 | Support surface |
| 36 | Distance |
| 37 | Bore |
| 38 | Bore |
| 39 | Length |
| 40 | External width |
| 41 | External width |
| 42 | Elastomer |
| 43 | Contact region |
| 44 | Contact region |
| 45 | Underlying ground |
| 46 | Binding mounting region |
| 47 | Contact zone |
| 48 | Contact zone |
| 49 | Pre-tensioned height |
| 50 | Binding plate |
| 51 | Contouring |
| 52 | Raised area |
| 53 | Raised area |
| 54 | Recess |
| 55 | Mounting rail |
| 56 | Binding part |
| 57 | Intermediate layer |
| 58 | Crest line |
| 59 | Longitudinal mid-axis |
| 60 | Moulded section |
| 61 | External face |
| 62 | Internal face |
| 63 | Side wall element |
| 64 | Side wall element |
| 65 | End face |
| 66 | End face |
| 67 | Boundary surface |
| 68 | Boundary surface |
| 69 | Recess |
| 70 | Sheath |

The invention claimed is:

1. Board-type runner device comprising several layers disposed between a running surface facing and a top layer, having a top belt lying immediately adjacent to the top layer and a bottom belt lying immediately adjacent to the running surface facing said layers forming a multi-layered element having a core component arranged in between and extending across virtually the entire length of the runner device, the multi-layered element having integrated compression-resistant projections or integrated compression-resistant spacing elements for receiving fixing screws for binding parts or for mounting rails thereof which penetrate the top belt as well as the top layer and terminate at least level with or above the top face of the runner device, wherein at least a bottom face of the core component adjoins a layer that is elastically flexible and rebounds when forces are applied to it and the bottom face is mounted and supported on the elastic layer and the core component, which is mounted on the elastic layer so as to be flexible at least in the direction perpendicular to a running surface of the runner device, has the compression-resistant projections formed on its top face or the integrated compression-resistant spacing elements are supported directly on its top face, and the fixing screws are anchored in the compression-resistant projections of the core component only or are additionally anchored in the core component, or the fixing screws are retained in the core component exclusively in a load-bearing arrangement with the compression-resistant spacing elements inserted in between.

2. Board-type runner device as claimed in claim 1, wherein the projections extend directly out from the core component or form an integral unit with the core component.

3. Board-type runner device as claimed in claim 1, wherein the core component is displaceable in a direction perpendicular to the top face of the runner device when the elastic layer, deformed.

4. Board-type runner device as claimed in claim 1, wherein a support surface of the compression-resistant projections or compression-resistant spacing elements is arranged at a distance above the top face of the top layer.

5. Board-type runner device as claimed in claim 1, wherein the compression-resistant projections of the core component or the compression-resistant spacing elements on the core component penetrate the top belt and the top layer of the runner device with a clearance.

6. Board-type runner device as claimed in claim 1, wherein the bottom belt overlaps the top face of steel edges spaced at a distance apart from one another and terminates substantially flush with the outer longitudinal side faces of the steel edges.

7. Board-type runner device as claimed in claim 1, wherein a length of the bores in the top belt and in the top layer running in a longitudinal direction of the runner device is longer than an external width of the compression-resistant projections or compression-resistant spacing elements measured in the longitudinal direction of the runner device.

8. Board-type runner device as claimed in claim 7, wherein a clearance between a compression-resistant projection or compression-resistant spacing element and wall surfaces of the associated bore in the top belt and in the top layer is filled with a soft elastomer.

9. Board-type runner device as claimed in claim 1, wherein the core component is a multi-layered body comprising a plurality of laminae made from wood and bonded to one another.

10. Board-type runner device as claimed in claim 9, wherein individual laminae have a greater height or lamina width and said laminae form the compression-resistant projections of the core component which penetrate at least an outer core component and the top belt.

11. Board-type runner device as claimed in claim 9, wherein said laminae of a greater height in the longitudinal direction of the runner device extend at least as far as the bottom face of the top layer at least in a binding mounting region provided on the runner device.

12. Board-type runner device as claimed in claim 1, wherein two core elements are integrated in the runner device, extending substantially parallel with one another and adjacent to one another.

13. Board-type runner device as claimed in claim 12, wherein each of the core elements comprises two tubular moulded sections inserted one inside the other with the elastic layer inserted in between and the compression-resistant projections or compression-resistant spacing elements are permanently joined exclusively to an inner one of the moulded sections and the projections or spacing elements are relatively displaceable and penetrate the layers above the inner moulded section.

14. Board-type runner device as claimed in claim 12, wherein the top face of the runner device has curved raised areas which are arcuate in cross section and at least part-regions of the cross sections of the two separate core elements are adapted so as to at least partially conform to the surface profiling of the runner device.

15. Board-type runner device as claimed in claim 1, wherein the core component is a first component of a multi-part core element and is at least partially received or enclosed by a second core component.

16. Board-type runner device as claimed in claim 15, wherein the elastic layer is arranged between the first core component and the second core component forming a means of partially receiving or enclosing the first core component.

17. Board-type runner device as claimed in claim 15, wherein the first core component and/or the multi-part core element is embedded in a relatively elastic expanded synthetic material with a density of from 200 $kg/m^3$ to 400 $kg/m^3$.

18. Board-type runner device as claimed in claim 15, wherein end faces of the first core component sit with virtually no clearance against boundary surfaces formed by a recess in the second core component.

19. Board-type runner device as claimed in claim 15, wherein longitudinal side faces of the first core component adjoin the second core component by which the latter is at least partially surrounded with virtually no clearance.

20. Board-type runner device as claimed in claim 19, wherein a linear guide is formed between the first core component and the second core component at least partially surrounding it, extending perpendicular to the top face of the runner device.

21. Board-type runner device as claimed in claim 1, wherein the first core component is a moulded section, which is at least partially surrounded by an another enclosing moulded section, the elastic layer being arranged between the two moulded sections.

22. Board-type runner device as claimed in claim 21, wherein at least one of the outer moulded sections are tubular elements made from metal materials and/or from synthetic materials or fibre materials.

23. Board-type runner device as claimed in claim 1, wherein the core component is enclosed by the elastic layer on all sides.

* * * * *